US005813880A

United States Patent [19]

Kodama

[11] Patent Number: 5,813,880

[45] Date of Patent: Sep. 29, 1998

[54] MOVABLE CONNECTOR

[75] Inventor: Shinji Kodama, Shizuoka, Japan

[73] Assignee: Yazaki Corporation, Tokyo, Japan

[21] Appl. No.: 938,607

[22] Filed: Sep. 26, 1997

[30] Foreign Application Priority Data

Sep. 30, 1996 [JP] Japan ..... 8-259336

[51] Int. Cl.[6] ..... H01R 13/627

[52] U.S. Cl. ..... 439/364; 439/567

[58] Field of Search ..... 439/557, 555, 439/552, 567, 364, 247, 248

[56] References Cited

U.S. PATENT DOCUMENTS

| | | | |
|---|---|---|---|
| 5,076,802 | 12/1991 | Colleran et al. | 439/468 |
| 5,259,785 | 11/1993 | Inaba et al. | 439/466 |
| 5,328,388 | 7/1994 | Fust et al. | 439/544 |
| 5,393,242 | 2/1995 | VaDerStuyg | 439/364 |
| 5,453,578 | 9/1995 | Ishii et al. | 439/138 |
| 5,486,119 | 1/1996 | Nabeshima et al. | 439/489 |
| 5,639,257 | 6/1997 | Yamaguchi et al. | 439/364 |
| 5,711,630 | 1/1998 | Kodama | 439/329 |

*Primary Examiner*—Neil Abrams
*Assistant Examiner*—T. C. Patel
*Attorney, Agent, or Firm*—Armstrong, Westerman, Hattori, McLeland & Naughton

[57] ABSTRACT

A movable connector movably provisionally held by means of resilient arms onto an instrument panel of a motor vehicle, which has a connector portion held on a frame, a nut on a tubular wall of the frame to be engaged with a bolt on a fixed connector, and a primary resilient arm provided on the frame for provisionally engaging with a panel-opening, thus disengaging the primary arm from a panel portion by tightening the bolt, wherein the primary arm is provided on the tubular wall with a flexure-fulcrum of the primary arm being located on the side of the fixed connector and with an end portion of the primary arm being located on the side of the panel portion. The primary arm itself is located in a hole on the frame with an end side of the primary arm projecting over the hole. And, an inclined guide piece relative to the panel-opening is formed at the end portion of the primary arm. Further, a secondary resilient arm in contact with the panel portion is provided on the frame in the transverse middle portion of the frame and is located in a hole on the frame with a tip of the secondary arm projecting over the hole. Thus, down-sizing and space-saving of the movable connector can be realized.

12 Claims, 5 Drawing Sheets

MOVABLE CONNECTOR

BACKGROUND OF THE INVENTION

1. Field of the Invention

The present invention relates to a movable connector movably provisionally held onto an instrument panel of a motor vehicle by means of a resilient arm and connected to a fixed connector on a meter-unit side by tightening a bolt.

2. Description of the Prior Art

FIG. 7 shows a movable connector disclosed in Japanese Patent Application No. Heisei 8-22491.

This movable connector 51 has a frame 52, synthetic resin, for holding a plurality, one on the right and left each, of male-connector portions 53 so as to be movable vertically and horizontally by means of spring pieces 54, and can provisionally engage with a panel-opening 59 of an instrument panel 58 by means of primary resilient arms 56 integrally formed with the frame 52 through a column 55 and extending back and forth and of secondary resilient arms 57 provided on both sides of the frame 52 and extending right and left. A tubular wall 60 is projected in the middle of the frame 52 for supporting a nut 70, and engaging projections 61 are formed at a front end portion of the tubular wall 60.

On the other hand, a fixed connector 62 has a plurality of female connector portions 64 fixed on a base plate portion 63, and a bolt 65 for connection is rotatably provided in the center. The base plate portion 63 is provided integrally with a meter-unit 66 fixed to the instrument panel 58 with bolts 67.

The tubular wall 60 of the movable connector 51 is inserted into another tubular wall 68 in the center of the fixed connector 62, and the engaging projections 61 on the tubular wall 60 engage with window portions 69 of the tubular wall 68, thereby forming provisional engagement of the movable connector 51 with the fixed connector 62. The tip of the bolt 65 presses the nut 70. The primary resilient arms 56 absorb vertical or horizontal slips of the frame 52 relative to the fixed connector 62, and the secondary resilient arms 57 absorb an error of dimension L between the base plate portion 63 and a panel portion 71, thereby ensuring the press of the nut 70 by the bolt 65.

And then, the movable connector 51 is drawn and connected to the fixed connector 62 by turning the bolt 65 to screw into the nut 70. Both the resilient arms 56, 57 move forward apart from the panel portion 7.

FIG. 8 shows a movable connector disclosed in Japanese Patent Application No. Heisei 8-140016.

On this movable connector 74, only primary resilient arms 77 are provided on a frame 76 holding male connector portions 75 movably, and secondary resilient arms 79 relative to the frame 76 are provided on an instrument panel 78. The primary resilient arms 77 hold the frame 76 movably up and down and right and left relative to the instrument panel 78, and the secondary resilient arms 79 hold the movable connector 74 movably back and forth.

In the former structure shown in FIG. 7, however, there has been a fear that if a parts 72 is arranged behind the instrument panel 58, the column 55 of the primary resilient arm 56 interferes with the parts 72 since the column 55 projects largely backward. And, there has been another fear of occurrence of a chatter by interference between the primary resilient arm 56 and the panel portion 71 during travel of a motor vehicle. Further, the secondary resilient arm 57 largely projecting over the frame 52 right and left requires a large space in the instrument panel 58.

Also, in the latter structure shown in FIG. 8, there has been a problem that a shape of the instrument panel 78 becomes complex since the secondary resilient arms 79 are provided within the panel 78.

SUMMARY OF THE INVENTION

An object of the present invention is to provide a movable connector enabling space-saving in an instrument panel by preventing largeness due to resilient arms and capable of preventing interference with other parts or with a panel portion.

In order to achieve the above object, as a first aspect of the present invention, the present invention adopts a movable connector having connector portions held on a frame, a nut provided on a tubular wall of the frame, with which a bolt on a mating fixed connector is engageable, and primary resilient arms provided on the frame for provisionally engaging with a panel-opening, thus enabling the primary resilient arms to be disengaged from a panel portion by tightening the bolt, wherein the primary resilient arms are provided on the tubular wall and a flexure-fulcrum of the arm is located on the fixed connector side and an end portion of the arm is located on the panel portion side. And, the primary resilient arm itself is located in a hole on the frame and an end side of the arm projects over the hole. And also, an inclined guide piece relative to the panel-opening is formed at the end portion of the primary resilient arm.

Further, as a second aspect of the present invention, the present invention adopts a movable connector having secondary resilient arms on the frame and able to contact with the panel portion, wherein the secondary resilient arms are located in the transverse middle portion of the frame. And, the secondary resilient arm itself is located in a hole on the frame and a tip of the arm projects over the hole.

According to the present invention, since the primary resilient arms do not largely project over the frame, the movable connector becomes down-sized, thereby reducing the space required for the movable connector within the instrument panel, while preventing interference with other parts or occurrence of a chatter caused by interference with the panel portion in a connector-connected state. And, the inclined guide piece of the primary resilient arm enables smooth and sure connection with the panel portion. Also, since the secondary resilient arms do not project over both sides of the frame, the movable connector further becomes down-sized, thereby also reducing the required space within the instrument panel.

The above and other objects and features of the present invention will be more apparent from the following description taken in conjunction with the accompanying drawings.

DETAILED DESCRIPTION OF THE PREFERRED EMBODIMENTS

FIG. 1 through FIG. 5 show an embodiment of a movable connector according to the present invention.

Figures 1, 1A:
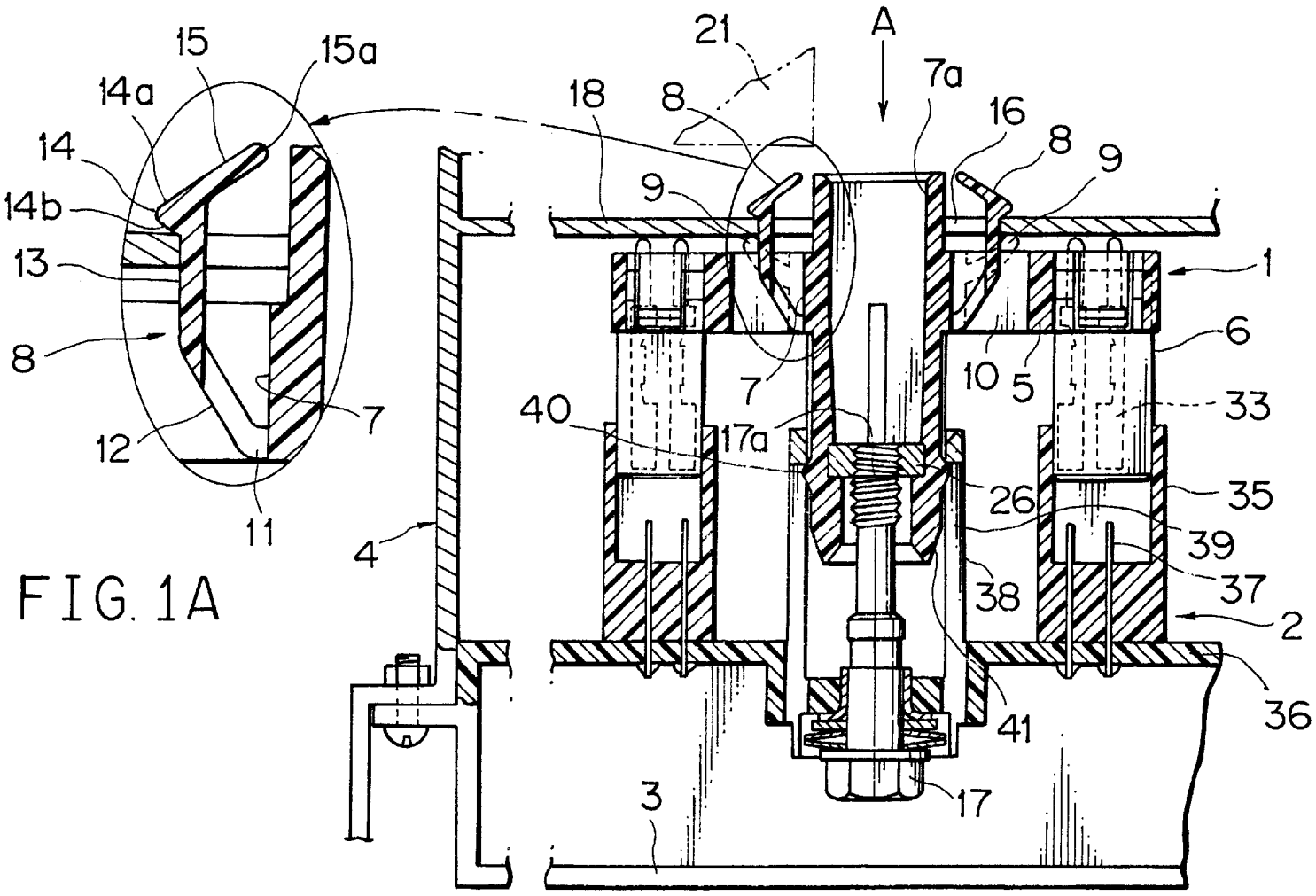
FIG. 1 is a longitudinal sectional view showing an embodiment of a movable connector, in a state of provisional connection with a fixed connector, in accordance with the present invention.

Referring to FIG. 1, the movable connector 1 provisionally engages with a fixed connector 2, and the fixed connector 2 is fixed to a meter-unit 3, and then the meter-unit 3 is fixed to an instrument panel 4.

The movable connector 1 is composed of a frame (a base plate portion) 5 made of synthetic resin, a pair of male-connector portions 6 each forwardly projectingly attached to both right and left sides of the frame 5, a primary resilient arm 8 projectingly provided rearwardly in about the back-and-forth middle of a tubular wall 7 formed in the center of the frame 5 for supporting a nut 26, and a secondary resilient arm 9 projectingly provided rearwardly aslant on the frame 5 and located adjacently to the primary resilient arm 8.

Both the resilient arm 8, 9 are formed integrally with the frame 5. The most important point of the embodiment resides in a structure of the primary resilient arm 8 and the secondary resilient arm 9, and the remaining structure is almost the same as the aforementioned prior arts.

Figure 3:
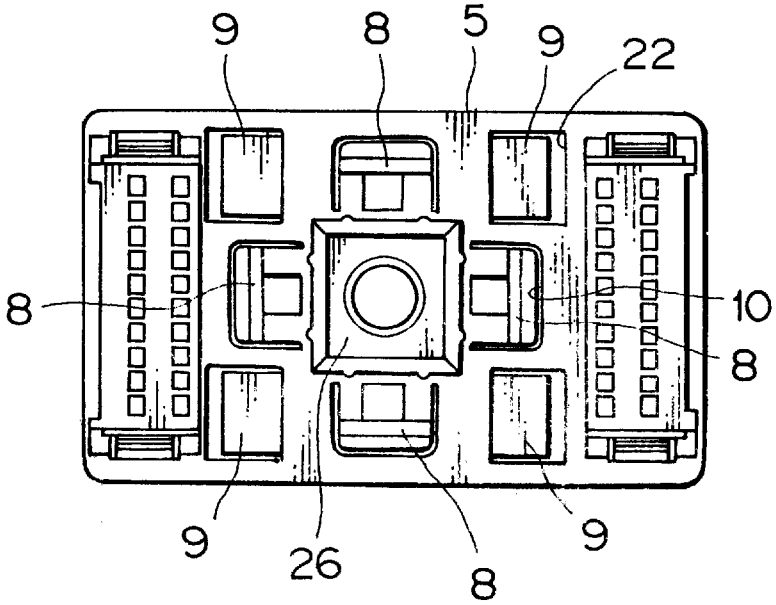
FIG. 3 is an elevational view of the movable connector viewed from a direction of an arrow Y in FIG. 1.

As shown in FIG. 3, i.e. an elevational view of the movable connector 1 viewed from a direction of an arrow Y in FIG. 1, four (4) holes 10 are formed on the frame 5 at every ninety degrees (90°) adjacent to each face of the rectangular column-like tubular wall 7 for supporting the nut 26, and as shown in FIG. 1, a base side of the primary resilient arm 8 is located in each hole 10 and an end side of the primary resilient arm 8 projects through the hole 10 and extends up to near the end of a rear-extending portion 7*a* of the tubular wall 7. A flexure-fulcrum 11 of the primary resilient arm 8 is located at the front end of the hole 10.

Figure 6:
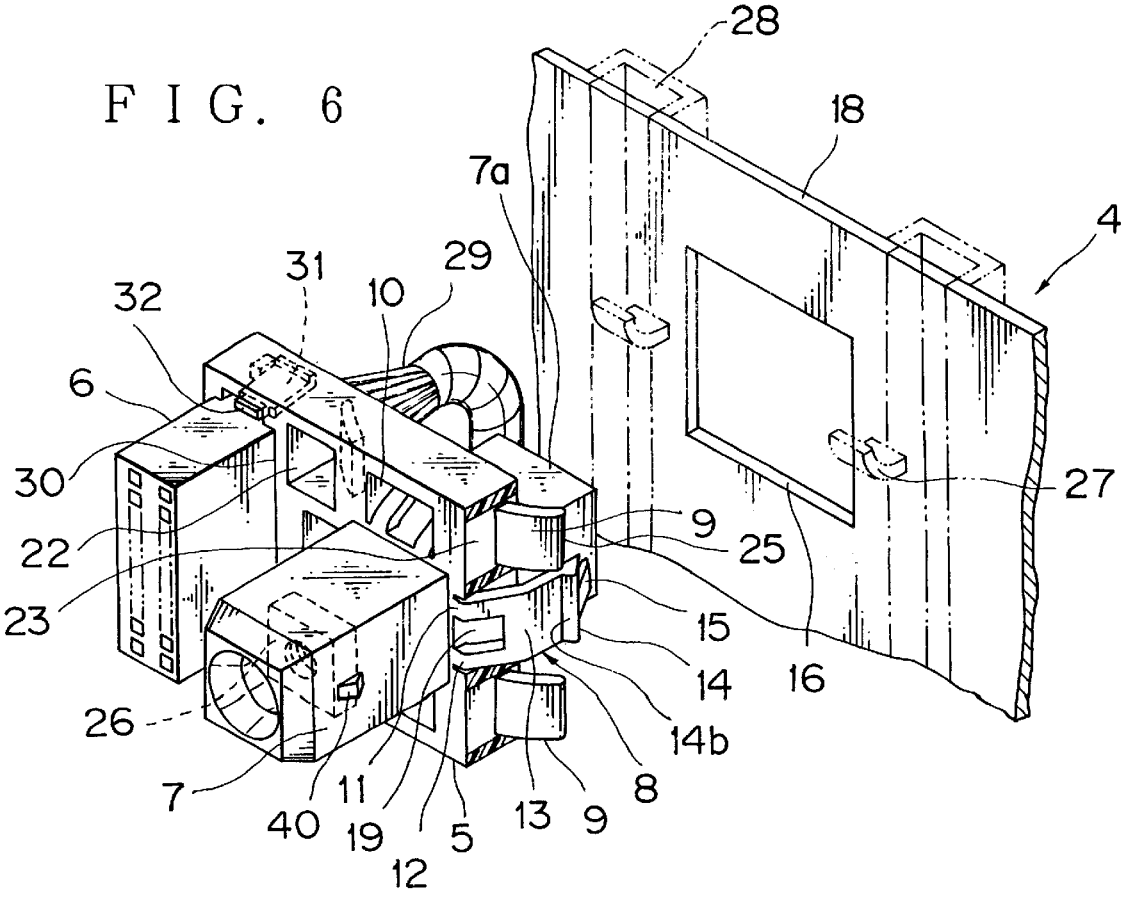
FIG. 6 is an exploded perspective view showing the movable connector to be engaged with a panel portion of an instrument panel.

As shown in FIGS. 1 and 6, the primary resilient arm 8 has an inclined portion 12 slantly standing on the tubular wall 7, a straight portion 13 continuing in substantially L-like to the inclined portion 12 and extending in parallel to the tubular wall 7, a provisional engaging projection 14 outwardly projecting at an end portion of the straight portion 13, and an inclined guide piece 15 projecting toward the tubular wall 7 from the provisional engaging projection 14.

The provisional engaging projection 14 has an approaching inclined plane 14*a* relative to a panel-opening 16 and an engaging inclined plane 14*b*. A tilt angle of the approaching inclined plane 14*a* and that of the engaging inclined plane 14*b* are equal to each other. As shown in FIG. 3, the four (4) primary resilient arms 8 are symmetrically arranged around the tubular wall 7.

Figure 2:
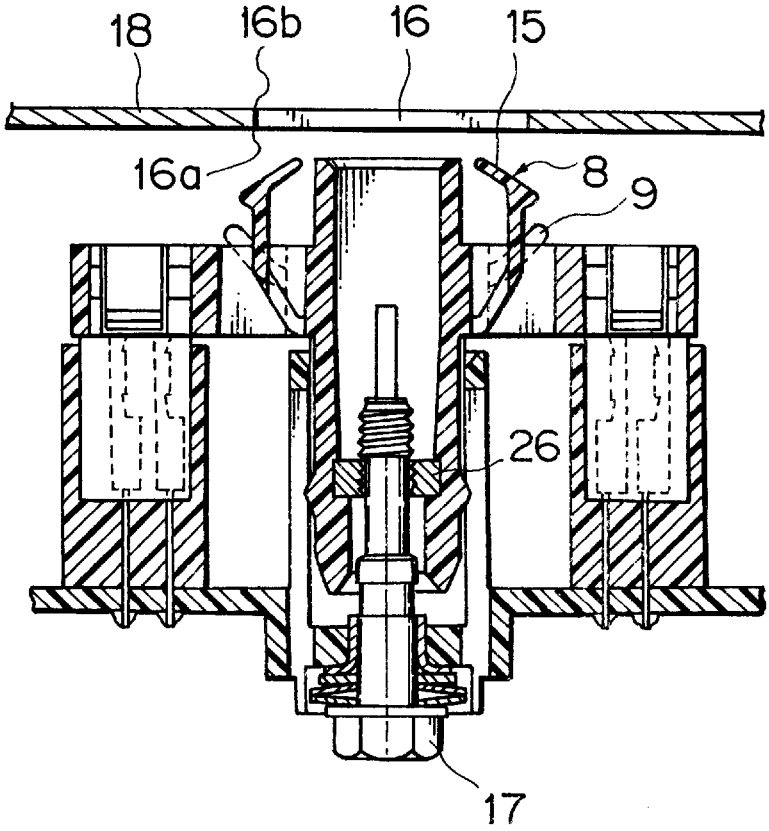
FIG. 2 is a longitudinal sectional view showing a state of complete connection of the connectors of FIG. 1.

As shown in FIG. 2, the inclined guide pieces 15 are located facing a periphery 16*a* of the panel-opening 16, and upon provisionally engaging the movable connector 1 with the panel-opening 16 as shown in FIG. 1 or upon shifting a connector-connected state in FIG. 2 to a connector-disconnected state in FIG. 1 by reversing a bolt 17, the inclined guide pieces 15 slide to make contact with the periphery 16*a* of the panel-opening 16 for enabling the primary resilient arm 8 to smoothly enter the panel-opening 16.

The primary resilient arm 8 bends inwardly aslant, i.e. to the tubular wall 7 side, about the flexure-fulcrum 11 (FIG. 1) and then is restored while the engaging inclined plane 14*b* of the provisional engaging projection 14 slides to make contact with the periphery 16*a* of the panel-opening 16. A panel portion 18 of the instrument panel 4 is put between the provisional engaging projection 14 of the primary resilient arm 8 and the secondary resilient arm 9 which pushes the movable connector 1 in a direction of connector-engagement, thereby provisionally engaging the movable connector 1 with the panel portion 18.

In FIG. 1, deflection of the primary resilient arm 8 may be limited by enabling a tip 15*a* of the primary resilient arm 8 to abut on the tubular wall 7. Further, as shown in FIG. 6, spring force of the primary resilient arm 8 may be regulated by making a notched hole 19 on the inclined portion 12 of the primary resilient arm 8.

The primary resilient arms 8 are located near the middle portion of the movable connector 1 and are put through the holes 10 on the frame 5, and only end sides of the arms 8, i.e. the inclined guide pieces 15 and a part of the straight portions 13, project rearwardly, i.e. toward the panel portion 18 side, over the frame 5, while the flexure-fulcrums Hare located at the front end of the frame 5 opposite to the panel portion 18. Accordingly, the primary resilient arms 8 do not project over both right and left sides of the frame 5 as in the prior art of FIG. 7, that is, the movable connector 1 becomes down-sized, thereby reducing the space for the movable connector 1 within the instrument panel 4.

Figure 7:
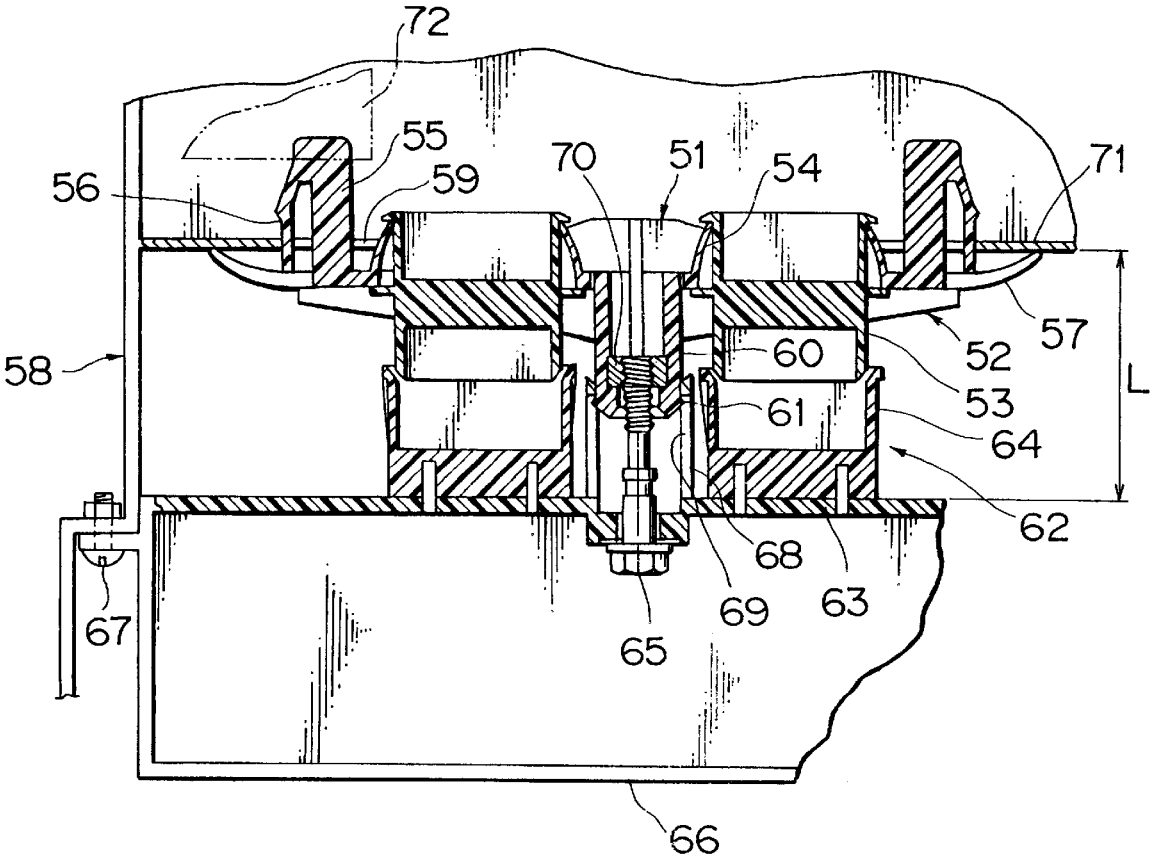
FIG. 7 PRIOR ART
FIG. 7 is a longitudinal sectional view showing a prior art movable connector.
Figure 8:
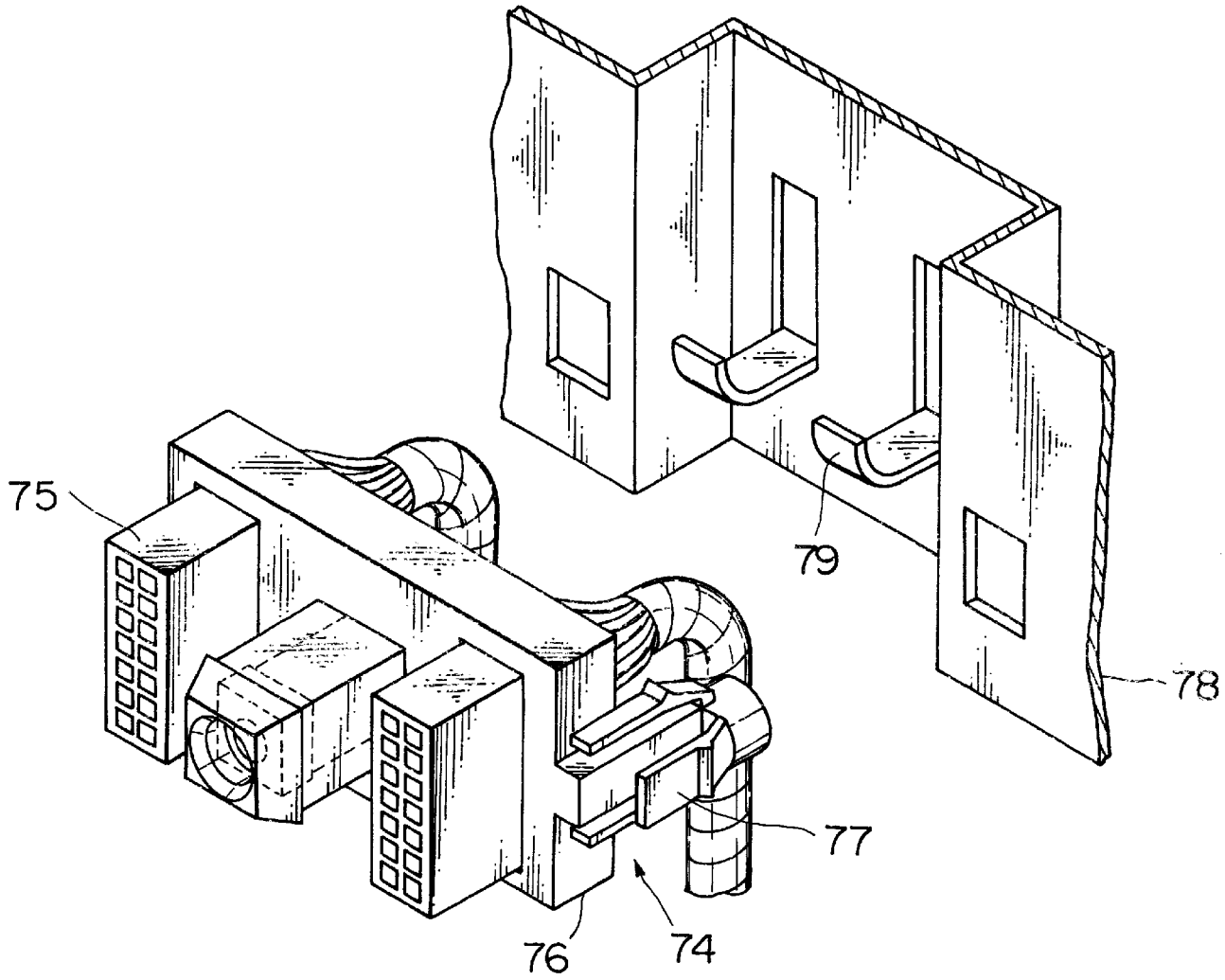
FIG. 8 PRIOR ART
FIG. 8 is an exploded perspective view showing another prior art movable connector.

Further, the primary resilient arms 8 are small-sized compared to the corresponding primary resilient arms 56 with the columns 55 in the prior art shown in FIG. 7 and, at the same time, do not largely project rearwardly. Therefore, other parts 21 can be closely arranged behind the panel portion 18 as shown in FIG. 1, and further, the primary resilient arms 8 are completely apart from the panel portion 18 in a connector-connected state in FIG. 2 for surely preventing occurrence of a chatter by interference with the panel portion 18.

Figure 4:
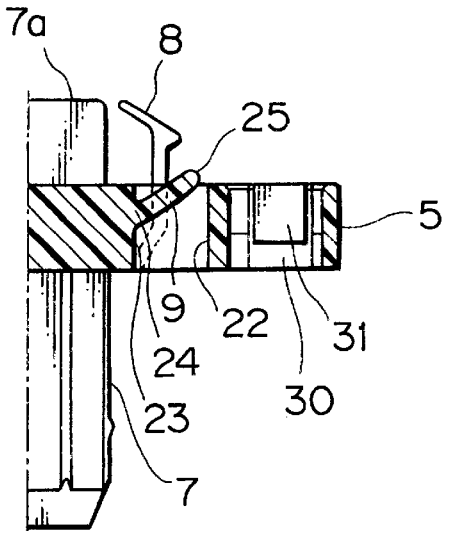
FIG. 4 is a partially sectional view showing a primary and a secondary resilient arms of FIG. 2.

On the other hand, among the four (4) primary resilient arms 8, also four (4) holes 22 are formed, each being arranged between adjoining two (2) resilient arms 8 as shown in FIG. 3, and the secondary resilient arm 9 is projected on each inner wall 23 of the holes 22 as shown in FIGS. 4 and 6. Each secondary resilient arm 9 also has a flexure-fulcrum 24 (FIG. 4) near the rear end of the holes 22 and tilts rearwardly with a slight bend, and a tip 25 of each secondary resilient arm 9 rearwardly projects over the hole 22. The secondary resilient arm 9 can enter the hole 22 when bent.

Figure 5A:
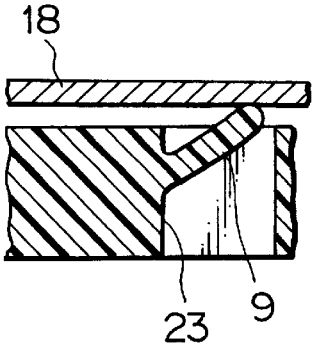
FIG. 5A is a sectional view showing the secondary resilient arm in an initial state.
Figure 5B:
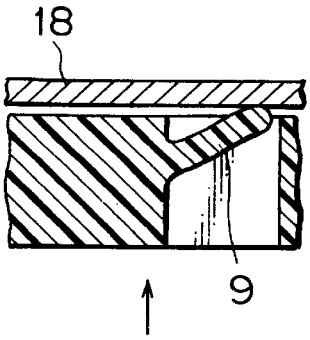
FIG. 5B is a sectional view showing the secondary resilient arm in a bent state.

When the meter-unit 3 is assembled with the instrument panel 4 as shown in FIG. 1, the secondary resilient arm 9 can bend as shown in FIGS. 5A and 5B, thereby absorbing a dimensional error between the meter-unit 3 and the panel portion 18. In a provisional connector-connected state shown in FIG. 1, the end 17*a* of the bolt 17 presses a nut 26 with a pressure by the secondary resilient arm 9, thus ensuring a screwing operation of the bolt 17.

The secondary resilient arms 9 each are located, adjacently to each primary resilient arm 8, near the center of the movable connector 1, i.e. in the transverse middle portion of the frame 5, and do not project over both sides of the frame 5 outwardly as in the prior art shown in FIG. 7, and only about the end halves of the arms 9 project over the holes 22 toward the panel portion 18, which makes the movable connector 1 compact like the primary resilient arms 8 do, thereby reducing the space for the movable connector 1 within the instrument panel 4.

As indicated by a broken line in FIG. 6, secondary resilient arms 27 provided on the panel portion 18 may be substituted for the secondary resilient arms 9 on the movable connector 1.

On the panel portion 18, the rectangular panel-opening 16 is formed to be engaged with the primary resilient arms 8 arranged vertically and horizontally and to correspond to the rear-extending portion 7*a* of the tubular wall 7. Grooves 28 may be formed on both sides of the panel-opening 16 for drawing out electric wires 29 from the male-connector portion 6.

As shown in FIGS. 4 and 6, the male-connector portion 6 is put through a hole 30 on the frame 5 and supported movably vertically and horizontally with an engaging projection 32 of the male-connector portion 6 being engaged with, for example, an elastic piece 31 inside the hole 30. Female terminals 33 (FIG. 1) connected to the electric wires 29 are accommodated in the male-connector portion 6.

A female-connector portion 35 (FIG. 1), corresponding to the male-connector portion 6, on the fixed connector 2 side is fixed to a base plate portion 36, and the base plate portion 36 is fixed to the meter-unit 3. Male terminals 37 connected to circuits (not shown) are provided on the base plate portion 36.

The bolt 17 on the fixed connector 2 is rotatably supported by a tubular wall 38 located in the center of the fixed connector 2, and an engaging projection 40 on the tubular wall 7 of the movable connector 1 engages with a window portion 39 of the tubular wall 38, thereby making the provisional connector-connected state of FIG. 1. At this time, the provisional engaging projections 14 of the primary resilient arms 8 provisionally engage with the panel portion 18. A tapered guide portion 41 to be inserted into the tubular wall 38 is formed at the front end of the tubular wall 7. These structures are the same as those of the prior art shown in FIG. 7.

What is claimed is:

1. A movable connector comprising:

a frame for holding a connector portion;

a nut provided on a tubular wall of said frame, with which a bolt provided on a mating fixed connector is engageable;

a primary resilient arm provided on said frame and provisionally engaged with a panel-opening, said primary resilient arm being disengaged from a panel portion by tightening said bolt; and wherein said primary resilient arm is provided on said tubular wall, and a flexure-fulcrum of said primary resilient arm is located on a side of said fixed connector and a free end portion of said primary resilient arm is located on a side of said panel portion farther from the fixed connector than said flexure-fulcrum.

2. The movable connector according to claim 1, wherein said primary resilient arm is located in a hole on said frame and an end side of said primary resilient arm projects over said hole.

3. The movable connector according to claim 1, wherein an inclined guide piece relative to said panel-opening is formed at the end portion of said primary resilient arm.

4. The movable connector according to claim 2, wherein an inclined guide piece relative to said panel-opening is formed at the end portion of said primary resilient arm.

5. The movable connector according to claim 1, further comprising a secondary resilient arm provided on said frame and capable of making contact with said panel portion, said secondary resilient arm being located in the transverse middle portion of said frame.

6. The movable connector according to claim 2, further comprising a secondary resilient arm provided on said frame and capable of making contact with said panel portion, said secondary resilient arm being located in the transverse middle portion of said frame.

7. The movable connector according to claim 3, further comprising a secondary resilient arm provided on said frame and capable of making contact with said panel portion, said secondary resilient arm being located in the transverse middle portion of said frame.

8. The movable connector according to claim 4, further comprising a secondary resilient arm provided on said frame and capable of making contact with said panel portion, said secondary resilient arm being located in the transverse middle portion of said frame.

9. The movable connector according to claim 5, wherein said secondary resilient arm is located in a hole on said frame and a tip of said secondary resilient arm projects over said hole.

10. The movable connector according to claim 6, wherein said secondary resilient arm is located in a hole on said frame and a tip of said secondary resilient arm projects over said hole.

11. The movable connector according to claim 7, wherein said secondary resilient arm is isolated in a hole on said frame and a tip of said secondary resilient arm projects over said hole.

12. The movable connector according to claim 8, wherein said secondary resilient arm is located in a hole on said frame and a tip of said secondary resilient arm projects over said hole.

* * * * *